United States Patent [19]

Kunimasa

[11] 4,190,986

[45] Mar. 4, 1980

[54] WAX TREATED GRINDSTONE

[75] Inventor: Oide Kunimasa, Kawanishi, Japan

[73] Assignee: Daichiku Co., Ltd., Kawanishi, Japan

[21] Appl. No.: 905,356

[22] Filed: May 12, 1978

[30] Foreign Application Priority Data

May 14, 1977 [JP] Japan ..... 52/55560

[51] Int. Cl.[2] ..... C09K 3/14; C08J 5/14

[52] U.S. Cl. ..... 51/295; 51/304

[58] Field of Search ..... 51/295, 304, 305

[56] References Cited

U.S. PATENT DOCUMENTS

| | | | |
|---|---|---|---|
| 2,687,357 | 8/1954 | Fiser | 51/295 |
| 2,829,035 | 4/1958 | Doughty | 51/304 |
| 3,804,600 | 4/1974 | Holman | 51/295 |
| 4,071,333 | 1/1978 | Like | 51/304 |

*Primary Examiner*—Donald J. Arnold

*Attorney, Agent, or Firm*—Koda and Androlia

[57] ABSTRACT

The grinding efficiency, performance and quality of the object ground can be increased by employing a grinder which has a grindstone treated with a wax which is impregnated into the grindstone by use of a heated solution of a higher aliphatic acid and higher alcohol group.

9 Claims, No Drawings

WAX TREATED GRINDSTONE

BACKGROUND OF THE INVENTION

1. Field of the Invention

The present invention relates to the field of improvements or treatments to grindstones and more particularly relates to treatment of grindstones to increase their efficiency in grinding metals and to reduce burning during the grinding operation.

2. Description of the Prior Art

It is well known to the art to treat a vitrified grindstone by physically filling the pores of the grindstone with a paraffin wax of similar material. Such treatment does not, however, produce much improvement in the efficiency of the performance of the grindstone. Thus, such a treatment is not typically practiced with the exception of immersion of the grindstone in a grinding oil during the grinding operation. It is also well known in the art that resinous grindstones may also be treated with such wax substances during the grinding operation. However, no serious study of the treatment of a grindstone to improve its grinding efficiency or performance has yet been conducted.

The present applicant has previously found as a result of an elaborate study of the wax treatment of resinous grindstones that an outstanding improvement in the performance in grinding efficiency of such grindstones can be obtained by treating a thin grindstone or a lamination of thin grindstones each of which has a thickness of less than 4 mm, with such a wax. The results of this study is disclosed in the Japanese patent application No. 24,229/77. The treatment disclosed therein is not only effective for resinous grindstones but it is also been found effective for abrasives made of sand on cloth such as are typically used in a belt-sander, disc-sander, drum-sander and the like. The method for treating such grindstones with such wax is also disclosed in the above referenced Japanese patent application.

BRIEF SUMMARY OF THE INVENTION

The present invention relates to a further improvement over the prior art wherein a resinous grindstone is treated with a mixture of a higher aliphatic acid and a higher alcohol to produce a greater grinding efficiency and quality of performance than ever previously observed. A most dramatic, unexpected and surprising result is that almost all burning is eliminated.

DETAILED DESCRIPTION OF THE PREFERRED EMBODIMENTS

The present invention is a novel method for treating a grindstone and a grindstone so treated with a wax solution which is impregnated into the grindstone by use of a heated solution of higher aliphatic acids and higher alcohols. More particularly, the aliphatic acid which are used in the present invention are saturated or unsaturated acids containing 5 to 30 carbon atoms in both straight and branched chains per molecule. Thus, for the purposes of this specification and the claims appended hereto higher aliphatic acid is defined to be saturated or unsaturated acid containing 5 to 30 carbon atoms per molecule. For example, one or more of the following higher aliphatic acid may be selected depending on the particular purpose or use to which the treated grindstone is to be applied: ($C_5H_{11}COOH$), ($C_7H_{15}COOH$), ($C_9H_{19}COOH$), ($C_{11}H_{23}COOH$), ($C_{15}H_{31}COOH$), ($C_{17}H_{35}COOH$), ($C_9H_{19}.C_7H_{15}.CHCOOH$), ($C_{17}H_{31}COOH$), ($C_{21}H_{43}COOH$), ($C_{29}H_{59}COOH$), and like constituted compounds according to the definition of higher aliphatic acid.

Among the above, the chemical structure of isostearic acid is as follows:

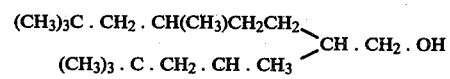

Similary, the higher alcohols which are used in the present invention are alcohols having 5 to 30 carbon atoms per molecule. Again, saturated or unsaturated higher alcohols in straight or branched chains may be used. Therefore, for the purposes of this specification and the claims appended hereto, higher alcohols is defined as alcohols having 5 to 30 carbon atoms per molecule. It has been found that alcohols having less than 4 carbon atoms per molecule are generally too volatile and the solution made by using such alcohols is too low in viscosity at room temperature to be of practical use. Such alcohols are therefore not preferred inasmuch as they are not well retained in the grindstone and are easily dispersed by the centrifugal force of the rotation of the grindstone during the operation. In addition, alcohols having more than 30 carbon atoms per molecule are also found to be unsuitable for treating grindstones by impregnation inasmuch as the melting points of these alcohols are generally too high. Examples of suitable alcohol compounds usable in the present invention are: ($C_5H_{11}OH$), ($C_8H_{17}OH$), ($C_{12}H_{25}OH$), ($C_{16}H_{33}OH$), ($C_{18}H_{37}OH$), ($C_9H_{19}.C_7H_{15}.CHCH_2OH$), and like constituted alcohols according to the definition of higher alcohols. Among the above, the chemical structure of isostearyl alcohol is as follows:

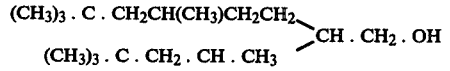

In one embodiment of the present invention, a mixture of higher alcohols such as a mixture of cetyl alcohol and stearyl alcohol and/or isostearyl alcohol has been found to be particularly useful or practical.

The liquid by which the grindstone is treated is prepared by mixing one or more of the higher aliphatic acids and higher alcohols as defined above in a preferred ratio is as described below. The ratio, by weight, is normally in the range of 10:90 to 90:10 of higher aliphatic acids to higher alcohols respectively, or more preferably approximately in a molar ratio of 1:1 of moles of higher aliphatic acids to moles of higher alcohols respectively. A mixture of equivalent amounts of stearic acid and isostearic acid is mixed in a 1:1 molar ratio with a mixture of cetyl alcohol and isostearyl alcohol. The mixture of cetyl and isostearyl alchol is prepared in a molar ratio of 6:4. Also found to be of particular usefulness is a mixture of stearic acid, cetyl alcohol and stearyl alcohol in a molar ratio of 5:3:2 respectively. Similary, a mixture of lauric acid and stearyc alcohol in a molar ratio of 6:4 has been found advantageous. The advantages achieved by the present invention can also be seen in the grindstones which are treated with a mixture specified above or with a conventionally waxed treated grindstone which has been subsequently treated by a higher aliphatic acid or higher alcohol having a mixture in a ratio set forth above.

A preheated grindstone is immersed in the treatment solution set forth above which solution has been heated to a temperature of approximately 100°-120° C. The grindstone remains immersed in the treatment solution for a few minutes before the excess treatment solution is drained from the grindstone which is then dried at room temperature. It is also possible to treat the grindstone in a dryer at 100°-150° C. in lieu of room temperature drying. Alternatively, the heated treatment solution maybe sprayed over the surface of the grindstone which is then blow dried by hot air. A satisfactory treatment is obtained even though the treatment is absorbed in only relatively small amounts into the grindstone.

In the illustrated embodiment the grindstones which were treated were resinous, and in particular those resinous grindstone using phenol resin as an adhesive produced markedly improved and superior results when treated in accordance with the present invention. In vitrified grindstones, the treatment of the present invention appears only to function as a lubricant and does not bring about an increase of grinding efficiency as is seen in the case of resinous grindstones and in particular phenol resinous grindstones.

As set forth above, the composition of the treatment solution prepared according to the present invention is a mixture of higher aliphatic acids and higher alcohols. A significant increase of grinding efficiency and the prevention or substantial elimination of burning during the grinding operation is observed in a resinous grindstone which has been thus treated with the mixture prepared according to the present invention. A single treatment of grindstones with such higher aliphatic acids or higher alcohols, or a single treatment according to the present invention with the additional use of esters or petroleum based waxes have been found to be particularly effective for grinders which are used for grinding non-ferrous metals such as copper, aluminum, zinc and the like. However, such a single treatment is generally found almost ineffective when used in grinders to grind stainless steel, high-duty steel, cast iron, soft iron, and other forms of ferrous metal. However, the desired results can be observed with multiply treated grindstones.

It is totally unexpected that a mixture of an acid and alcohol could produce any improvement in grinding efficiency or performance and in particular, the outstanding type of improvement as observed in the present invention regardless of whether the metal to be ground is ferrous or non-ferrous. Although the mechanism which results in this substantial and dramatic improvement is not perfectly understood or known, it is conjectured that immersion of the grindstone in higher aliphatic acids and higher alcohols causes a reaction with the grindstone material which absorbs frictional heat generated by a resinous grindstone during operation. It is also possible that water which is produced by the esterification reaction which occurs may function as a coolant. It is further conjectured that the mixed chemical system as disclosed in the present invention functions as a lubricant. In any case, it is clear that such multiple reactions are inter active in a multiplicative manner. It is also conceivable that an interaction with phenol resin occurs because of the fact that no effect is observed in a vitrified grindstone. Although white smoke may be generated during the grinding operation, it is observed that no blue or bluish purple burning is ever observed. In addition, when soft iron or similar material is being ground, the ground surface assumes a metallic luster or in some cases a somewhat brownish cast during the grinding operation.

The structure and effects of the present invention can be better understood and explained by particular examples as set forth below.

EXAMPLE 1

A commercially obtainable off-set resinous grindstone and a laminated resinous grindstone disc were obtained. The grindstone standard in each case was A-36-P while the size of the commercial off-set resinous grindstone was 100×6×15 mm and the laminated resinous grindstone was 150×4×19 mm laminated in four layers with a space between each lamination of 0.1 mm.

Stearic acid, which is solid at room temperature, and isostearic acid, which is liquid at room temperature, were used as the higher alphatic acids. A mixture containing 60% cetyl alcohol and 40% stearyl alcohol by weight, which is also solid at room temperature, was used as the higher alcohols. The above aliphatic acids higher alcohols were mixed in equivalent ratios by weight and heated to 120° C. to obtain a homogeneous liquid. The grindstones described above were then totally immersed in the specified treatment solution for three to five minutes, removed from the solution, drained, and then dried at a temperature of 100°-120° C. By this treatment, it was found that approximately 2 to 4 g and 15 to 25 g of treatment solution was impregnated and retained in the commercial and laminated grindstones respectively.

The following grinding tests were then conducted with the above treated grindstones. Alluminum, and alluminum alloy (63 S) and zinc alloy (one kind of dicast), a cast iron, and stainless steel were selected as test specimens for grinding. A test piece of each material measuring 10 mm in width, 200 mm in length was ground by the above grinding stones powered by a disc sander made by Toshiba, Model No. DG-100G (100 V, 5.7 A, 510 W, 4300 m/min.) with a manually applied pressure of approximately 5 kg. Grinding periods of one minute each were repeated five times. The amount of grinding and the wear of the grindstones was measured at the end of each grinding period. The grindstones were treated with and without immersion in paraffin and were also tested in the same manner for comparison. The results are tabularly listed in Table 1 below.

TABLE 1

| | grind. time (min.) | amount of grinding | | | |
|---|---|---|---|---|---|
| | | stainless steel* | cast iron* | alluminum alloy** | zinc alloy** |
| Example 1 | 1 | 5.0 | 17.2 | 11.0 | 28.4 |
| | 2 | 4.2 | 19.2 | 10.5 | 20.7 |
| | 3 | 5.3 | 15.5 | 8.5 | 29.0 |
| | 4 | 5.0 | 16.6 | 9.3 | 16.0 |
| | 5 | 6.8 | 16.4 | 9.4 | 21.0 |
| total | (g) | 26.3 | 84.9 | 48.7 | 115.1 |
| amount of wear | (g) | 7.7 | 6.3 | 10.2 | 2.9 |
| Comparison 1 treated with paraffin wax | 1 | | | 7.3 | 15.6 |
| | 2 | | | 6.8 | 14.3 |
| | 3 | | | 6.4 | 11.6 |
| | 4 | | | 5.3 | 12.3 |
| | 5 | | | 6.0 | 7.9 |
| total | (g) | | | 31.8 | 61.4 |
| amount of wear | (g) | | | 12.6 | 4.0 |
| Comparison 2 without | 1 | 3.4 | 9.0 | 3.8 | 6.1 |

TABLE 1-continued

| | grind. time (min.) | amount of grinding stainless steel* | cast iron* | alluminum alloy** | zinc alloy** |
|---|---|---|---|---|---|
| treatment | 2 | 3.2 | 10.3 | 3.0 | 5.8 |
| | 3 | 2.9 | 8.0 | 2.1 | 4.4 |
| | 4 | 3.0 | 8.3 | 1.3 | 3.8 |
| | 5 | 3.2 | 8.9 | 0.8 | 3.8 |
| total | (g) | 15.7 | 44.5 | 11.0 | 23.9 |
| amount of wear | (g) | 0.8 | 0.9 | 2.6 | 2.1 |

*A-36-P, 150mm (diameter) × 4mm four discs are laminated.
**A-36-P, 100 × 6 ×0 15 grindstone of off set type.

As can be seen from the results set forth in Table 1 above, the laminated rotary grinder treated in accordance with the present invention achieves 26.3 g of grinding as opposed to 15.7 g which was achieved by grinder not treated according to the present invention in the grinding test when grinding stainless steel. Similarly, the treated grinder ground 84.9 g of cast iron as opposed to 44.5 g of the cast iron for an untreated grinder in the same grinding test. In both cases, the grinder treated according to the present invention achieved an increase in the amount ground by a factor of 1.7 to 1.9 over that of an untreated grinder. Although the wear of the grinder or the grindstone is greater in a grinder having the treatment of the present invention, the increase in grinding efficiency more than compensates for the increased wear.

The effect of the treatment on an off-set grinder when grinding aluminum alloy and zinc alloy is even more remarkable than that observed in stainless steel and cast iron. With the conventional commercial grinder shown in comparison 2, grinding becomes almost impossible as the operation proceeds because of an accumulation of dust removed from the ground alluminum alloy which adheres to the surface of the grinding disc. A significant improvement can be observed in the grinder illustrated in comparison 2 of Table 1 when it is immersed in paraffin wax. An even greater improvement is shown when the grinder is treated according to the present invention. The grinding operation can be conducted with a relatively light touch as the resistance at the time of grinding is small and the dust from the grinding disperses in powder form without adhering to the surface of the treated grindstone, whereby the practical limitation of the grinding duration is substantially eliminated. The treated grinder of the present invention shows that an increase in the amount ground per unit length of time (g/min.) by as much as 4.4 times that of a grinder without treatment and 1.5 times greater than a grinder with a conventional paraffin wax treatment. Similarly, when grinding a zinc alloy, the treated grinder shows an increase of 5 times and 1.9 times respectively as compared with a non-treated and conventionally paraffin wax treated grinder.

It is still another advantage of the present invention that the generation of heat at the time of grinding is substantially eliminated. The surface being ground assumes a beautiful metallic luster and smoothness such that polishing is often unnecessary. On the other hand, the conventional grinder of Comparison 2 always caused burning during the grinding operation and in the case of stainless steel and cast iron, the ground surface may assume a blue or purplish blue color which is caused by the generated heat.

EXAMPLE 2

In the second example, the ability to maintain the grinding efficiency and the amount of grinding as measured by ground weight as against the predetermined amount of wear of the grinder are examined. In other words, the amount of stainless steel removed in a time in which is necessary for an off-set grinder such as described above having a diameter of 100mm to wear down to a diameter of 70 mm was measured. The results are tabulated in Table 2 below. The test was conducted in the same manner as employed for Example 1 above: the grinding was continued for 1 minute followed by 1 minute of non-operation repeated five times. During the 1 minute of non-operation or pause, the amount of ground material removed and the amount of wear on the grinder were measured.

The results of Table 2 indicate that when compared to an untreated conventional grinder, the rate of wear on a treated grinder is half as much, the amount of removal of stainless steel is three times greater, the removal rate about 1.5 times greater, and the grinding efficiency approximately three times greater than the conventional grinder.

TABLE 2

| | Example 2 (A) | Comparison 3 (B) | A/B |
|---|---|---|---|
| treatment | same as Ex. 1 | no treatment | |
| time required to reduce the diameter from 100 mm to 70 mm (min) | 20.5 | 10.3 | 2.0 |
| amount of wear of the grinder (g) | 35.4 | 33.2 | |
| amount of stainless steel removed (g) | 103.8 | 36.1 | 2.9 |
| removal rate of stainless steel (g/min) | 5.1 | 3.5 | 1.5 |
| grinding efficiency | 2.94 | 1.08 | 2.7 |
| luster of the grinding surface | metallic luster ~ brown | blue ~ bluish purple | |
| estimated temp. of the surface (°C.) | 500–600 | 1000–1200 | |

EXAMPLE 3

Using the same type of off-set grinder as used in Example 1 above, a continuous grinding test was repeated. Each grinding period continued for five minutes and was repeated four times. Pure aluminum (Al050) was the ground object. The contact pressure on the ground object was maintained at 1.8 kg to prevent overheating of the grinder motor. The results are shown in Table 3 below. The differences between the treated grinder and the conventional grinder are even more apparent then evidenced in Table 1. Whereas it was impossible to perform continuous grinding of aluminum with a conventional off-set grinder, a grinder treated according to the present invention showed a decrease in the amount ground by only approximately 50%. In addition, a remarkable improvement in the quality of grinding was observed.

TABLE 3

| grinding time (min) | amount ground (g) Example 3 | Comparison 4 |
|---|---|---|
| 1–5 | 19.8 | 4.2 |
| 5–10 | 13.5 | 1.5 |

TABLE 3-continued

| grinding time (min) | amount ground (g) Example 3 | Comparison 4 |
|---|---|---|
| 10-15 | 16.2 | 0.9 |
| 15-20 | 12.3 | 1.1 |
| total (1-20) | 61.8 | 7.7 |
| amount of wear of the grinder (g) | 7.1 | 3.2 |
| color tone of the surface ground | metallic luster light brown (ca.30%) | blue ~ purple |

Although the present invention has been described in relation to particular embodiments and the examples, it must be understood that many of modifications and the alterations may be made in the present invention without departing from its spirit and scope.

I claim:

1. In a grinder, an improvement comprising:

a grindstone impregnated with a solution containing a higher aliphatic acid having 5 to 30 carbon atoms per molecule and a higher alcohol having 5 to 30 carbon atoms per molecule mixed together at a range of ratios by weight of 10:90 to 90:10;

whereby grinding efficiency and quality of grinding performance is dramatically and surprisingly improved.

2. The improvement of claim 1 wherein said grindstone is a resinous grindstone.

3. The improvement of claim 1 wherein said grindstone is also wax treated.

4. The improvement of claim 1 wherein said solution is composed of said higher aliphatic acid to said higher alcohol in a ratio of approximately 1:1 molar.

5. The improvement of claim 1 wherein said solution is comprised of a mixture of equal amounts of stearic acid and isostearic acid mixed in an approximately equal molar ratio with a mixture of cetyl and isostearyl alcohol mixed in a 6:4 molar ratio respectively.

6. The improvement of claim 1 wherein said solution is comprised of a mixture of stearic acid, cetyl alcohol and stearyl alcohol in a molar ratio of approximately 5:3:2 respectively.

7. The improvement of claim 1 wherein said solution is comprised of a mixture of lauric acid and stearyl alcohol in a molar ratio of approximately 6:4 respectively.

8. A grinding wheel comprising a grindstone impregnated with a solution comprising a higher aliphatic acid having 5 to 30 carbon atoms per molecule and a higher alcohol having 5 to 30 atoms per molecule mixed together at a range of ratios by weight of 10:90 to 90:10 by heating the solution, immersing the grinding stone in the solution, draining the excess solution from the grindstone and allowing grindstone to dry.

9. A grinding wheel according to claim 8 wherein said solution is heated to a temperature between 100° and 120° C. and the grindstone is dried in a dryer at a temperature between 100° and 150° C.

* * * * *